US011370234B2

(12) United States Patent
Yanagimachi et al.

(10) Patent No.: US 11,370,234 B2
(45) Date of Patent: Jun. 28, 2022

(54) CUTTER DEVICE AND PRINTER

(71) Applicant: SEIKO EPSON CORPORATION, Tokyo (JP)

(72) Inventors: Daisuke Yanagimachi, Matsumoto (JP); Hiroyuki Ishimori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 151 days.

(21) Appl. No.: 16/826,537

(22) Filed: Mar. 23, 2020

(65) Prior Publication Data

US 2020/0307008 A1 Oct. 1, 2020

(30) Foreign Application Priority Data

Mar. 26, 2019 (JP) ..... JP2019-057891

(51) Int. Cl.

| | |
|---|---|
| ***B41J 11/70*** | (2006.01) |
| ***B41J 11/66*** | (2006.01) |
| ***B26D 1/08*** | (2006.01) |
| ***B26D 1/09*** | (2006.01) |

(52) U.S. Cl.

CPC ..... *B41J 11/666* (2013.01); *B26D 1/085* (2013.01); *B26D 1/095* (2013.01); *B41J 11/70* (2013.01)

(58) Field of Classification Search

CPC ..... B41J 11/666; B41J 11/70; B41J 11/706; B26D 1/085; B26D 2001/006

See application file for complete search history.

(56) References Cited

U.S. PATENT DOCUMENTS 5,505,148 A * 4/1996 Conley, Jr. ..... B65H 35/0006 112/130

FOREIGN PATENT DOCUMENTS

| | | | |
|---|---|---|---|
| JP | 2005335315 A | * | 12/2005 |
| JP | 2011-143601 A | | 7/2011 |
| KR | 2008014944 A | * | 3/2009 |

* cited by examiner

*Primary Examiner* — Daniel J Colilla

(74) *Attorney, Agent, or Firm* — Workman Nydegger

(57) ABSTRACT

A cutter device, comprising: a first blade including a first cutting edge extending in a first direction; a second blade including a second cutting edge extending in a second direction; and a guide portion provided at a position anterior to the second blade in the second direction, wherein the second blade moves in the second direction to cut a recording medium while leaving a part thereof uncut, and when the second blade is located posterior, in the second direction, to a position where the second blade cuts the recording medium, at least a part of the guide portion is located to protrude farther in the first direction than the first cutting edge, or located at a same position as the first cutting edge.

7 Claims, 10 Drawing Sheets

CUTTER DEVICE AND PRINTER

The present application is based on, and claims priority from JP Application Serial Number 2019-057891, filed Mar. 26, 2019, the disclosure of which is hereby incorporated by reference herein in its entirety.

BACKGROUND

1. Technical Field

The present disclosure relates to a cutter device that cuts a recording medium and a printer including the cutter device.

2. Related Art

An auto-cutter-equipped inkjet printer that includes an auto cutter disposed in a position adjacent to an inkjet head in a recording paper transport direction is disclosed (see JP-A-2011-143601).

According to JP-A-2011-143601 described above, the auto cutter includes a fixed blade disposed across a recording paper transport path, and a movable blade located downstream of the fixed blade in the transport direction. A portion of recording paper located between the fixed blade and the movable blade is cut in a width direction when the movable blade moves toward the fixed blade.

In the configuration described above, a recording medium is cut while a part thereof is left uncut by the movement of the movable blade. Then, when back feeding that is transport from the downstream side toward the upstream side in the transport direction is performed, an end portion of the recording medium generated downstream of the fixed blade by the cutting may abut the fixed blade.

SUMMARY

A cutter device according to one exemplary embodiment of the present disclosure includes a first blade including a first cutting edge extending in a first direction, a second blade including a second cutting edge extending in a second direction, and a guide portion provided at a position anterior to the second blade in the second direction, wherein the second blade moves in the second direction to cut a recording medium while leaving a part thereof uncut, and, when the second blade is located posteriror to a position, where the second blade cuts the recording medium, in the second direction, at least a part of the guide portion is located to protrude farther in the first direction than the first cutting edge, or located at a same position as the first cutting edge.

DESCRIPTION OF EXEMPLARY EMBODIMENTS

Exemplary embodiments of the present disclosure will be described below with reference to each of the accompanying drawings. Each of the drawings is merely illustrative for describing the present exemplary embodiment. Since each of the drawings is illustrative, a shape and a ratio may not be precise, may not match each other, and may be partially omitted.

1. SCHEMATIC CONFIGURATION OF PRINTER

Figure 1:
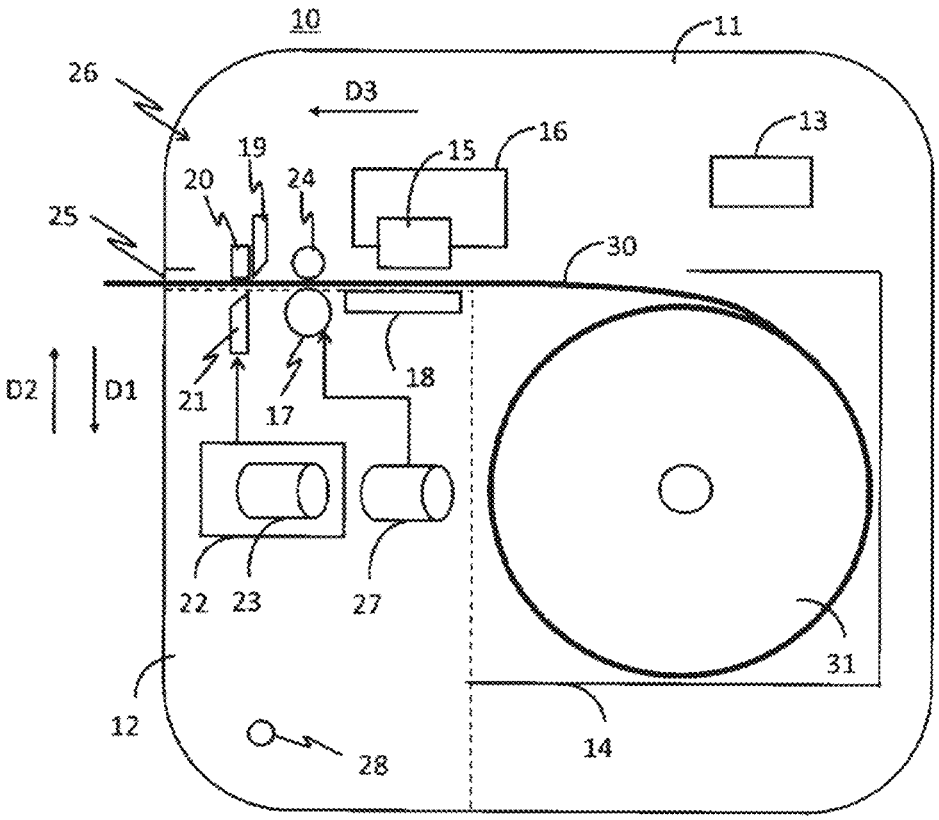
FIG. 1 is a diagram schematically illustrating a configuration of a printer with a lid closed.

FIG. 1 schematically illustrates an internal configuration of a printer 10 according to the present exemplary embodiment.

The printer 10 includes a cutter device 26. The printer 10 may be described as a printing device, a recording device, a liquid discharging device, and the like. The printer 10 generally includes a printer main body 11 and a lid 12 that can open and close a part of an inner side of the printer main body 11 to the outside. FIG. 1 illustrates a state in which the lid 12 is closed. In FIG. 1, a boundary between the printer main body 11 and the lid 12 is illustrated by a dashed line.

Figure 2:
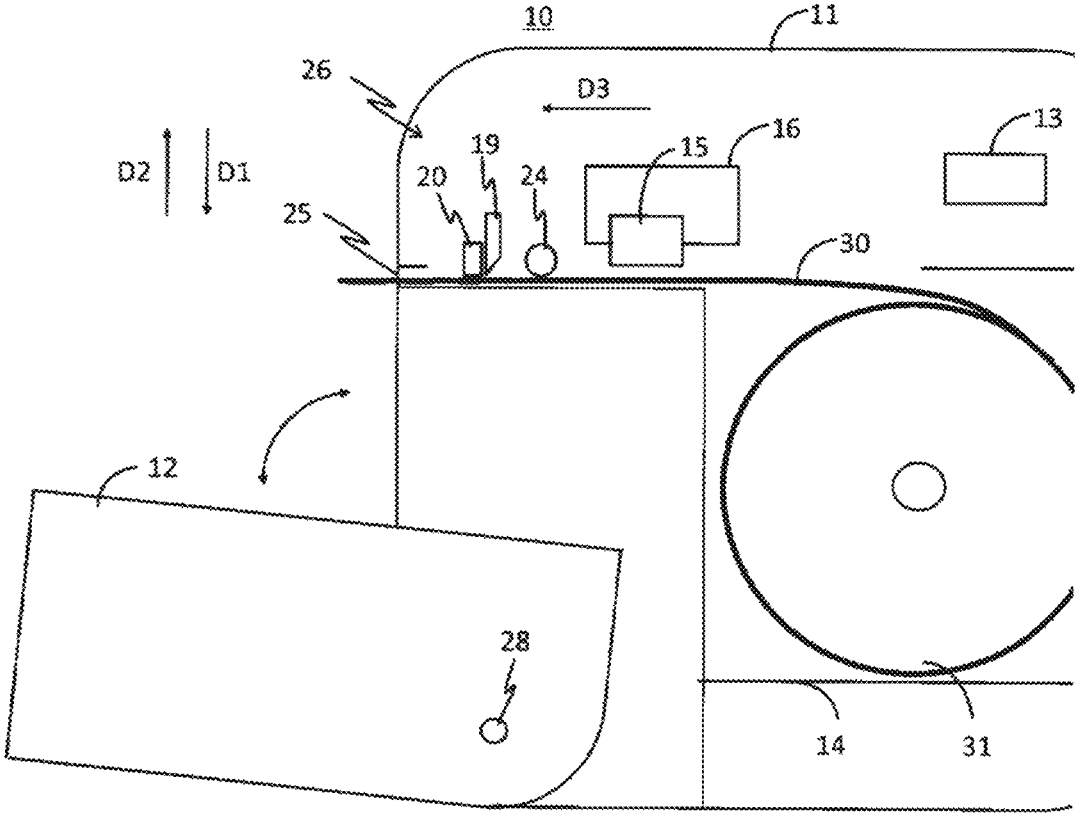
FIG. 2 is a diagram schematically illustrating a configuration of the printer with the lid open.

FIG. 2 illustrates the internal configuration of the printer 10 similarly to FIG. 1. However, FIG. 2 illustrates a state in which the lid 12 is open. Further, in FIG. 2, the internal configuration of the lid 12 illustrated in FIG. 1 is omitted. A specific mechanism for opening and closing the lid 12 with respect to the printer main body 11 is particularly no object. In the examples illustrated in FIGS. 1 and 2, the lid 12 is coupled to the printer main body 11 via a shaft 28 supported by the printer main body 11, and is configured to open and close with respect to the printer main body 11 by rotationally moving around the shaft 28. Alternatively, the lid 12 may be configured to open by being pulled out from the printer main body 11 in a constant direction, and close by being pushed back in a reverse direction to the constant direction. The printer main body 11 corresponds to a specific example of a first structure. Further, the lid 12 corresponds to a specific example of a second structure that is different from the first structure and can change a posture with respect to the first structure.

The printer main body 11 includes a control unit 13, a housing portion 14, a recording head 15, a carriage 16, a fixed blade 19, a roller 24, and the like. The control unit 13 includes, for example, a CPU as a processor, a memory, and the like. The control unit 13 controls the printer 10 by performing, by the processor, arithmetic processing according to a program stored in the memory. The processor is not limited to a single CPU, and may be a plurality of CPUs, may be configured to perform processing by a hardware circuit such as an application specific integrated circuit (ASIC), or may be configured to perform processing in cooperation between the CPU and the hardware circuit.

The housing portion 14 forms a space for housing a recording medium 30. In the present exemplary embodiment, an elongated recording medium is assumed as the recording medium 30. The elongated recording medium is also referred to as a continuous sheet. A roll paper main body 31 acquired by winding the recording medium 30 being the elongated sheet in a roll shape is housed in the housing portion 14. A user opens the lid 12, then houses the roll paper main body 31 into the housing portion 14, and closes the lid 12. However, the recording medium 30 may be a material other than paper as long as it is a medium that can be recorded by a recording agent such as ink and toner and that can be cut by the cutter device 26. Further, the roll paper main body may simply be described as roll paper.

According to FIG. 1, the lid 12 includes a roller 17, a platen 18, a movable blade 21, a movable blade drive unit 22, and the like. When the lid 12 is closed, a gap is created between the printer main body 11 and the lid 12 as a transport path for the recording medium 30. An arrow indicated by a reference sign D3 indicates a direction of such a transport path, namely, a transport direction D3. The transport direction D3 is horizontal or inclined with respect to the horizontal direction. Here, the transport direction D3 is assumed to be horizontal. A discharge port 25 is located the most downstream in the transport path, and the recording medium 30 is discharged from the discharge port 25 to the outside of the printer 10. The platen 18 forms a part of the transport path. The platen 18 supports, from below, the recording medium 30 that corresponds to a portion drawn from the roll paper main body 31 to the transport path.

A roller pair of the rollers 17 and 24 facing each other across the transport path is disposed in a position downstream of the platen 18 in the transport direction D3. Upstream and downstream in the transport direction D3 are simply referred to as upstream and downstream below. The rollers 17 and 24 transport the recording medium 30 by rotating while sandwiching the recording medium 30 therebetween. For example, of the rollers 17 and 24, the roller 17 disposed on the lid 12 is an active roller that rotates under power by a transport motor 27. On the other hand, of the rollers 17 and 24, the roller 24 disposed on the printer main body 11 is a driven roller that rotates in accordance with the rotation of the active roller. Note that the roller 17 may be described as a transport roller.

In the example in FIG. 1, the transfer motor 27 rotating the roller 17 is disposed inside the lid 12. However, the transport motor 27 may be disposed on the printer main body 11.

A configuration including the transport motor 27 and the rollers 17 and 24 is referred to as a transport unit. In other words, the transport unit transports the recording medium 30. Although not illustrated in the drawings, the transport unit may include, in addition to the rollers 17 and 24, several rollers for transporting the recording medium 30 in, for example, a position upstream of the recording head 15 and the like.

Figure 3:
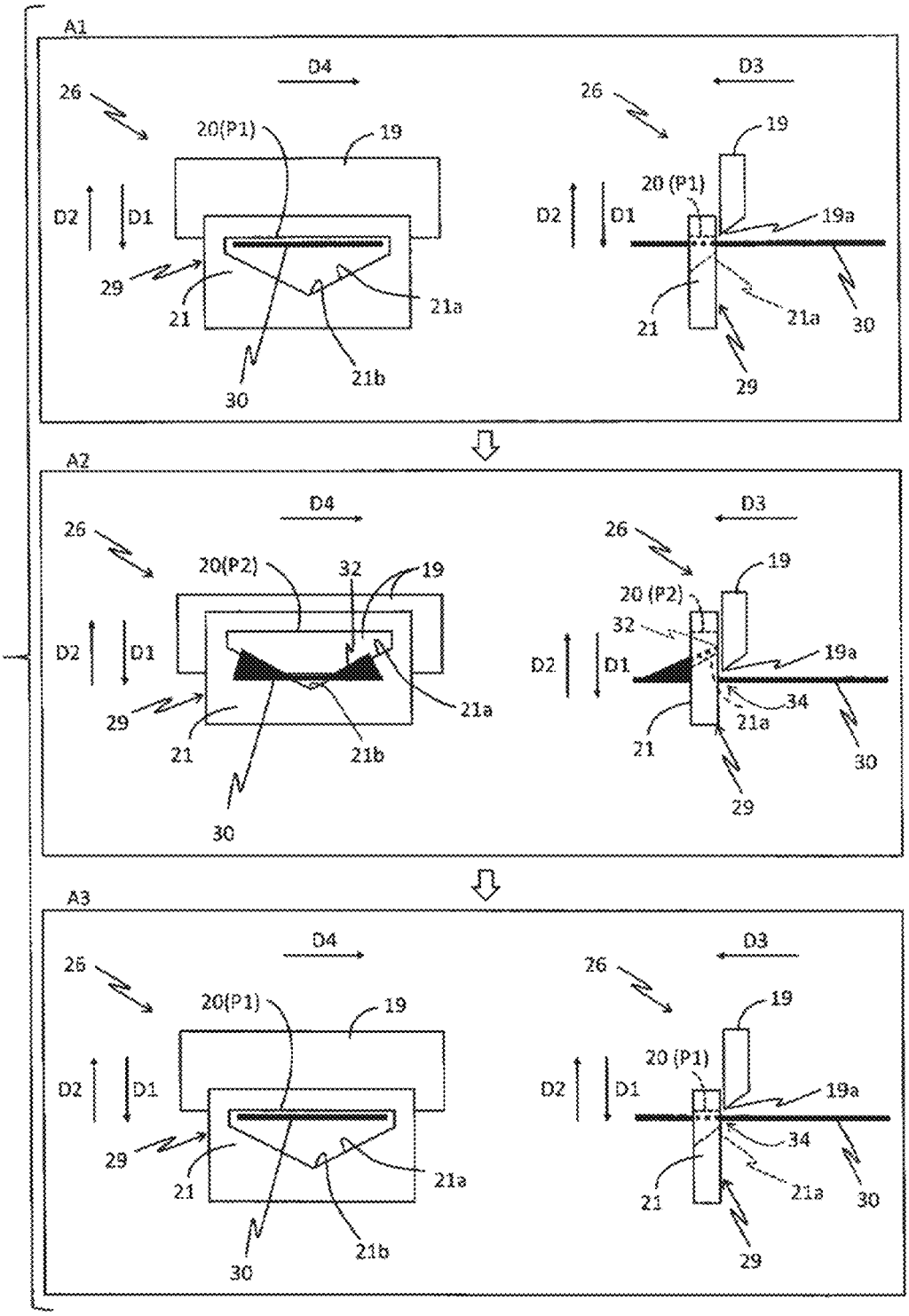
FIG. 3 is a diagram illustrating an operation of a cutter device according to a first example.

The recording head 15 is disposed above the platen 18. The recording head 15 includes a plurality of nozzles capable of discharging ink, and performs recording by an inkjet method. The recording head 15 may be described as a printing head, a print head, a liquid discharging head, and the like. The recording head 15 receives a supply of ink from an ink cartridge (not illustrated). The recording head 15 is mounted on the carriage 16. The carriage 16 is reciprocally movable in parallel with a main scanning direction that intersects the transport direction D3. In FIGS. 1 and 2, a direction perpendicular to the plane of FIGS. 1 and 2 is the main scanning direction. In FIG. 3 and the like described below, the main scanning direction is indicated by an arrow indicated by a reference sign D4. The recording head 15 performs recording on the recording medium 30 supported by the platen 18 by discharging ink from the nozzle as the carriage 16 moves.

The recording head 15 may be a so-called line head that is fixed inside the printer main body 11 without being mounted on the carriage 16. In other words, the recording head 15 may include a nozzle row in which a plurality of nozzles are arranged across a range corresponding to a width of the recording medium 30 in the main scanning direction described above, and may perform recording on the recording medium 30 without moving. In a configuration in which the recording head 15 is a line head, the carriage 16 is not required.

The fixed blade 19, the movable blade 21, and a guide portion 20 are disposed in a position downstream of the rollers 17 and 24. A configuration including at least the fixed blade 19, the movable blade 21, and the guide portion 20 is the cutter device 26. For example, the movable blade drive unit 22 may also be understood as a part of the cutter device 26. Note that the fixed blade 19 is an example of a first blade, and the movable blade 21 is an example of a second blade. The fixed blade 19 is fixed inside the printer 10. Specifically, the fixed blade 19 is disposed on the printer main body 11 with a cutting edge facing in a first direction D1 that intersects the transport direction D3. The cutting edge of the fixed blade 19 is a first cutting edge.

The movable blade 21 is disposed on the lid 12 with a cutting edge facing in a second direction D2 that is a reverse direction to the first direction D1. The cutting edge of the movable blade 21 is a second cutting edge. Further, the movable blade 21 is disposed downstream of the fixed blade 19. The movable blade 21 can move in the first direction D1 and the second direction D2. The movable blade 21 moves in the second direction D2, thereby cutting the recording medium 30 located between the cutting edge of the fixed blade 19 and the cutting edge of the movable blade 21 while leaving a part of the recording medium 30 uncut. The cutting of the recording medium 30 while leaving a part thereof uncut is referred to as partial cutting.

In the example in FIG. 1, the first direction D1 is a downward direction and the second direction D2 is an upward direction. Thus, according to the example in FIG. 1, the movement of the movable blade 21 is a vertical movement. However, the downward direction may not be an exactly vertically downward direction, and, similarly, the upper direction may not be an exactly vertically upward direction. The movable blade 21 is moved by the movable blade drive unit 22. The movable blade drive unit 22 includes a motor 23 for moving the movable blade 21, a gear (not illustrated), and the like, and moves the movable blade 21 in the first direction D1 and the second direction D2 by applying power by the motor 23 to the movable blade 21. The movable blade drive unit 22 may be a mechanism capable of moving the movable blade 21. As the movable blade drive unit 22, for example, a crank mechanism in JP-A-2011-143601 described above may be adopted.

The guide portion 20 is configured to guide the partially cut recording medium 30. The guide portion 20 is located forward of the movable blade 21 in the second direction D2 and moves together with the movable blade 21. The guide portion 20 is disposed downstream of the fixed blade 19. In FIG. 1, particularly, a shape of the movable blade 21 and the guide portion 20 is easily described. Details of the cutter device 26 including the movable blade 21 and the guide portion 20 will be described in each example described below.

Of course, the printer 10 appropriately includes a known configuration such as a communication interface for communicating with an external device, such as a computer, a screen and an indicator for indicating visual information to a user, an operation receiving unit, such as a button and a switch for receiving an operation from a user.

2. EXAMPLE

2-1. First Example

FIG. 3 illustrates a situation where an operation of the cutter device 26 in a first example transitions to states A1, A2, and A3. In FIG. 3, for each of the states A1, A2, and A3, a front view of the cutter device 26 is illustrated on the left, and a side view of the cutter device 26 is illustrated on the right. The front view is a view of a line of sight directing from a downstream side toward an upstream side. The side view is a view of a line of a sight that is orthogonal to the transport direction D3 and is also orthogonal to the first direction D1 and the second direction D2. Hereinafter, the front in the first direction D1 and the rear in the second direction D2 may be simply expressed as down, and the front in the second direction D2 and the rear in the first direction D1 may be simply expressed as up.

The state A1 is a state before the cutter device 26 performs the partial cutting on the recording medium 30. In the first example, the movable blade 21 and the guide portion 20 are formed by an integral member 29. The member 29 is referred to as a movement member 29. In other words, the movement member 29 moves in the first direction D1 and the second direction D2 by the movable blade drive unit 22. The movement member 29 is a plate-like member, and has a hole that penetrates the movement member 29 in the transport direction D3 at substantially the center of the movement member 29, that has a horizontal upper end portion and a V-shaped lower end portion, and that has the entire circumference closed. The V-shaped end portion forming such a hole is a cutting edge 21*a* of the movable blade 21. The lowermost portion of the V-shaped cutting edge 21*a*, namely, a portion that corresponds to the bottom of the V shape is referred to as a deepest portion 21*b* of the cutting edge 21*a*. The recording medium 30 passes through the hole formed in the movement member 29.

The cutting edge 21*a* and a portion below the cutting edge 21*a* of the movement member 29 correspond to the movable blade 21. A portion above the movable blade 21 of the movement member 29 corresponds to the guide portion 20. In FIG. 1, the movable blade 21 and the guide portion 20 are described separately from each other, but, in the first example, the movable blade 21 and the guide portion 20 are integrally formed. The movement member 29 is disposed on the lid 12, and also partially enters the printer main body 11.

The guide unit 20 guides the recording medium 30 by an end portion facing the recording medium 30. The guide of the recording medium 30 is to regulate a position and a posture of the recording medium 30. Thus, when the guide portion 20 is indicated in FIG. 3 and other drawings, the end portion of the guide portion 20 facing the recording medium 30 is basically indicated with a partial exception. In the first example, an upper end portion of the movement member 29 that forms a part of the hole is the end portion of the guide portion 20 facing the recording medium 30.

In the state A1, the guide portion 20 is located in a guide position P1. The guide position P1 is a position in which at least a part of the guide portion 20 protrudes in the first direction D1 relative to a cutting edge 19*a* of the fixed blade 19. Alternatively, the guide position P1 may be the same position as the cutting edge 19*a*. More specifically, the guide position P1 is a position of the guide portion 20 when the end portion of the guide portion 20 facing the recording medium 30 protrudes in the first direction D1 relative to the cutting edge 19*a*, or a position of the guide portion 20 in which the end portion is located in the same position as the cutting edge 19*a* in the first direction D1.

When the guide portion 20 is located in the guide position P1, the movable blade 21 is located in the rear in the second direction D2 relative to a position in which the movable blade 21 cuts the recording medium 30. The position in which the movable blade 21 cuts the recording medium 30 is a position in which the cutting edge 21*a* comes into contact with the recording medium 30. The position in the rear in the second direction D2 relative to the position in which the movable blade 21 cuts the recording medium 30 is also referred to as a non-cutting position of the movable blade 21.

A state in which the movement member 29 in the state A1 is moved in the second direction D2 is the state A2. The movement member 29 moves in the second direction D2, thereby cutting the recording medium 30 located between the cutting edge 19*a* of the fixed blade 19 and the cutting edge 21*a* of the movable blade 21. The movement of the movement member 29 stops at timing earlier than timing at which the deepest portion 21*b* of the cutting edge 21*a* reaches the recording medium 30. Therefore, a part of the width of the recording medium 30 is left uncut. In other words, the state A2 is a state in which the cutter device 26 partially cuts the recording medium 30. In the present exemplary embodiment, the "width" refers to a length and a range in an orientation parallel to the main scanning direction D4. The portion uncut by the partial cutting is referred to as an uncut portion 34. In the state A2 in which the partial cutting is terminated, the guide portion 20 is located in a retracted position P2.

Note that a shape of the cutting edge 21*a* including the deepest portion 21*b* is not limited to the V shape as illustrated, and may be any shape that is configured to partially cut the recording medium 30 so as to generate the uncut portion 34. For example, a shape of the cutting edge 21*a* including the deepest portion 21*b* may be partially or entirely curved.

As a result of the recording medium 30 being partially cut, an end portion 32 of the recording medium 30 is newly generated downstream of the fixed blade 19. The end portion 32 faces upstream. The end portion 32 generated by the cutting of the recording medium 30 due to the movement of the movable blade 21 in the second direction D2 is dragged by the movement of the movable blade 21 and moves in the second direction D2. The state A2 represents a situation where the end portion 32 moves in the second direction D2 in this manner, and thus a partial region of the recording medium 30 including the end portion 32 is pushed upward. When the recording medium 30 is back-fed with the partial region of the recording medium 30 including the end portion 32 being pushed upward, the end portion 32 comes into contact with the fixed blade 19. Thus, in the present exemplary embodiment, the cutter device 26 causes the guide portion 20 to act on the end portion 32.

A state in which the movement member 29 in the state A2 is moved in the first direction D1, and a position of the guide portion 20 is set to the guide position P1 again is the state A3. The guide portion 20 pushes the end portion 32 back in the first direction D1 by moving the movement member 29 in the first direction D1 after the partial cutting. As a result, when the guide portion 20 reaches the guide position P1, the partial region of the recording medium 30 including the end portion 32 returns to the original position between the cutting edge 19*a* of the fixed blade 19 and the cutting edge 21*a* of the movable blade 21, and the contact as described above does not occur.

The first example will be further described with reference to FIGS. 4 and 5.

Figure 4:
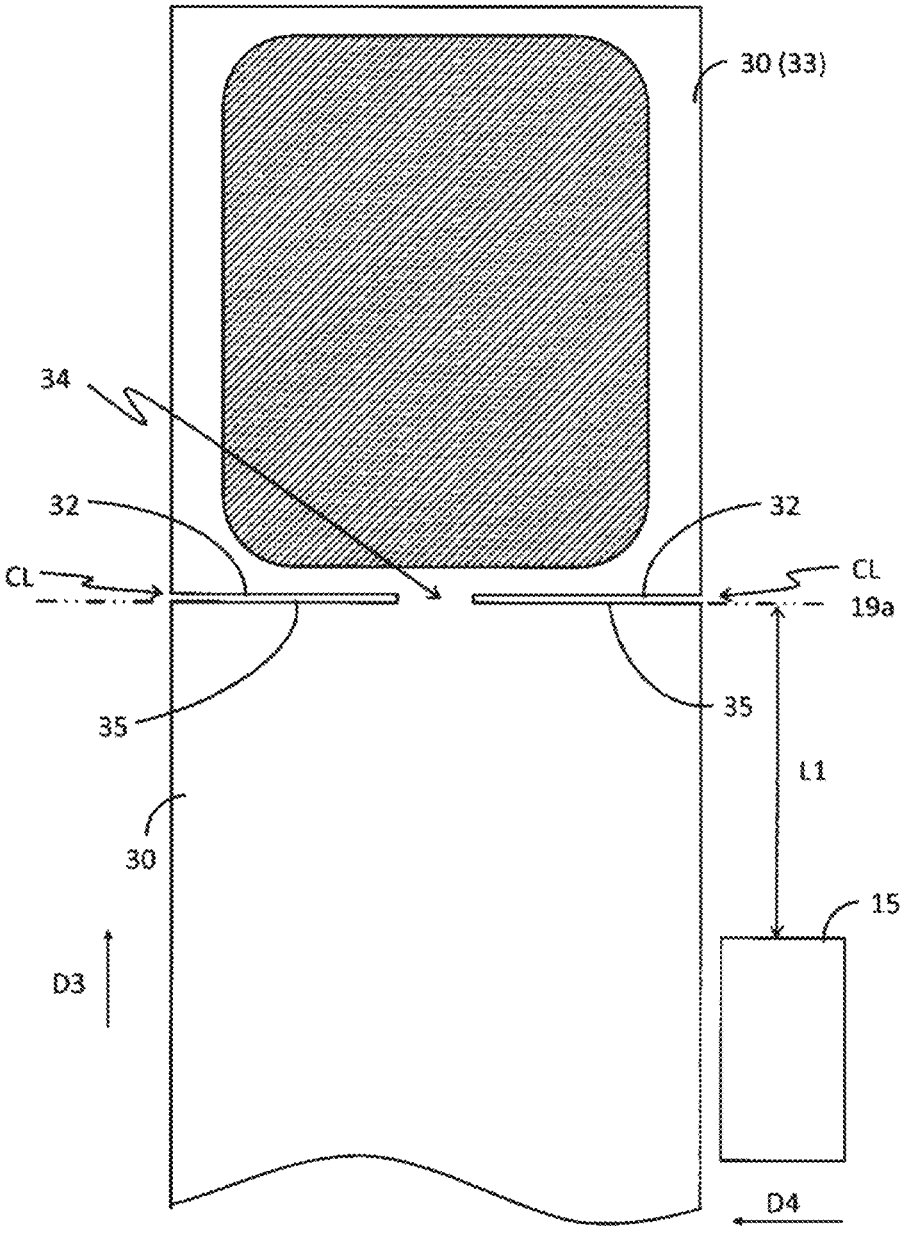
FIG. 4 is a diagram illustrating a partially cut recording medium from a viewpoint from above.

FIG. 4 is a diagram illustrating the partially cut recording medium 30 from a viewpoint from above. FIG. 5 illustrates, by a flowchart, recording processing performed by the control unit 13. The control unit 13 performs the recording processing on the recording medium 30 by controlling each of the recording head 15, the carriage 16, the transport unit, and the cutter device 26. The flowchart in FIG. 5 is achieved by the cycle of steps S100, S110, S120, S130, and S140, but will be described from step S100 here.

The control unit 13 performs recording on the recording medium 30 based on recording data (step S100). In this case, the control unit 13 moves the carriage 16 and also causes the recording head 15 to perform ink discharge based on the recording data. As a result, recording is performed on a region of the recording medium 30 supported by the platen 18. The recording data is, for example, image data representing some sort of object such as a document, an illustration, and a photograph, and defines discharge or non-discharge of a dot of ink for each pixel. The control unit 13 may acquire the recording data by inputting the recording data through communication with an external computer and the like, or generating the recording data according to a user instruction.

After step S100, the control unit 13 performs forward transport of the recording medium 30 by controlling the drive of the transport unit, namely, the transport motor 27 (step S110). The forward transport is transport in the transport direction D3, namely, transport from the upstream side to the downstream side. In order to distinguish from reverse transport in step S140, an expression of a forward direction is used for convenience's sake. In step S110, the control unit 13 transports the recording medium 30 to a position in which the region of the recording medium 30 recorded in step S100 reaches downstream of the movable blade 21.

After step S110, the control unit 13 moves the movement member 29 by controlling the drive of the movable blade drive unit 22, namely, a motor 23, and performs the operation from the state A1 to the state A2 described in FIG. 3 (step S120). In this way, the partial cutting is performed.

After step S120, the control unit 13 moves the movement member 29 by controlling the drive of the movable blade drive unit 22, namely, the motor 23, and performs the operation from the state A2 to the state A3 described in FIG. 3 (step S130). Step S130 is referred to as return processing. A partial region of the recording medium 30 including the end portion 32 that is pushed up in the second direction D2 by the partial cutting is pushed back in the first direction D1 by the return processing.

In FIG. 4, a cut line of the partially cut recording medium 30 is indicated by a reference sign CL. Although the description is omitted in FIG. 4, the fixed blade 19, the movable blade 21, and the guide portion 20 are naturally present in the vicinity of the cut line CL. In FIG. 4, a position in the transport direction D3 of the cutting edge 19*a* of the fixed blade 19 is indicated by a chain double-dashed line. In the width of the recording medium 30, the uncut portion 34 is present between the cut line CL and the cut line CL. A region of the recording medium 30 downstream of the cut line CL is a recorded region 33 in which an object is recorded based on the recording data in step S100. A hatching pattern applied to the recorded region 33 represents some sort of recorded object.

The end portion 32 and the end portion 35 of the recording medium 30 are generated with the cut line CL interposed therebetween. The end portion 32 is an end of the recorded region 33. The end portion 35 is a tip of the recording medium 30 that is recorded next. At a point in time when the partial cutting is performed, a distance L1 is generated between the recording head 15 and the end portion 35 in the transport direction D3. A region corresponding to the distance L1 in the recording medium 30 is a white paper region. In order to use such a white paper region in the next recording, the control unit 13 performs the reverse transport of the recording medium 30 by controlling the transport unit after step S130 (step S140). The reverse transport is transport from the downstream side to the upstream side, namely, a back feed. In step S140, the control unit 13 causes back-feeding of the distance L1 or a distance acquired by subtracting a predetermined margin from the distance L1, for example.

The return processing in step S130 returns the end portion 32 to a position in which the end portion 32 is not in contact with the fixed blade 19. Thus, the back-feeding in step S140 is performed smoothly without occurrence of a catch of the end portion 32 on the fixed blade 19. After step S140, the control unit 13 performs step S100 and the subsequent steps.

Figure 6:
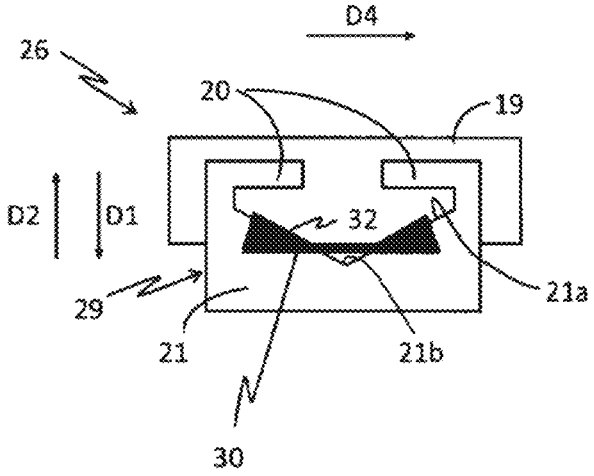
FIG. 6 is a diagram illustrating a modified example of a shape of a movement member.

FIG. 6 illustrates a modified example of a shape of the movement member 29. FIG. 6 is a front view of the cutter device 26 in the state A2. As illustrated in FIG. 6, the guide portion 20 may be partially interrupted on the inside of the width of the recording medium 30. In other words, the hole that is formed in the movement member 29 and includes the end portion of the guide portion 20 and the cutting edge 21*a* of the movable blade 21 may have a shape in which a part of the entire circumference is opened. Even with the shape illustrated in FIG. 6, the guide portion 20 can act on the end portion 32 of the recording medium 30 in the return processing (step S130) and push back the end portion 32.

2-2. Second Example

Figure 7:
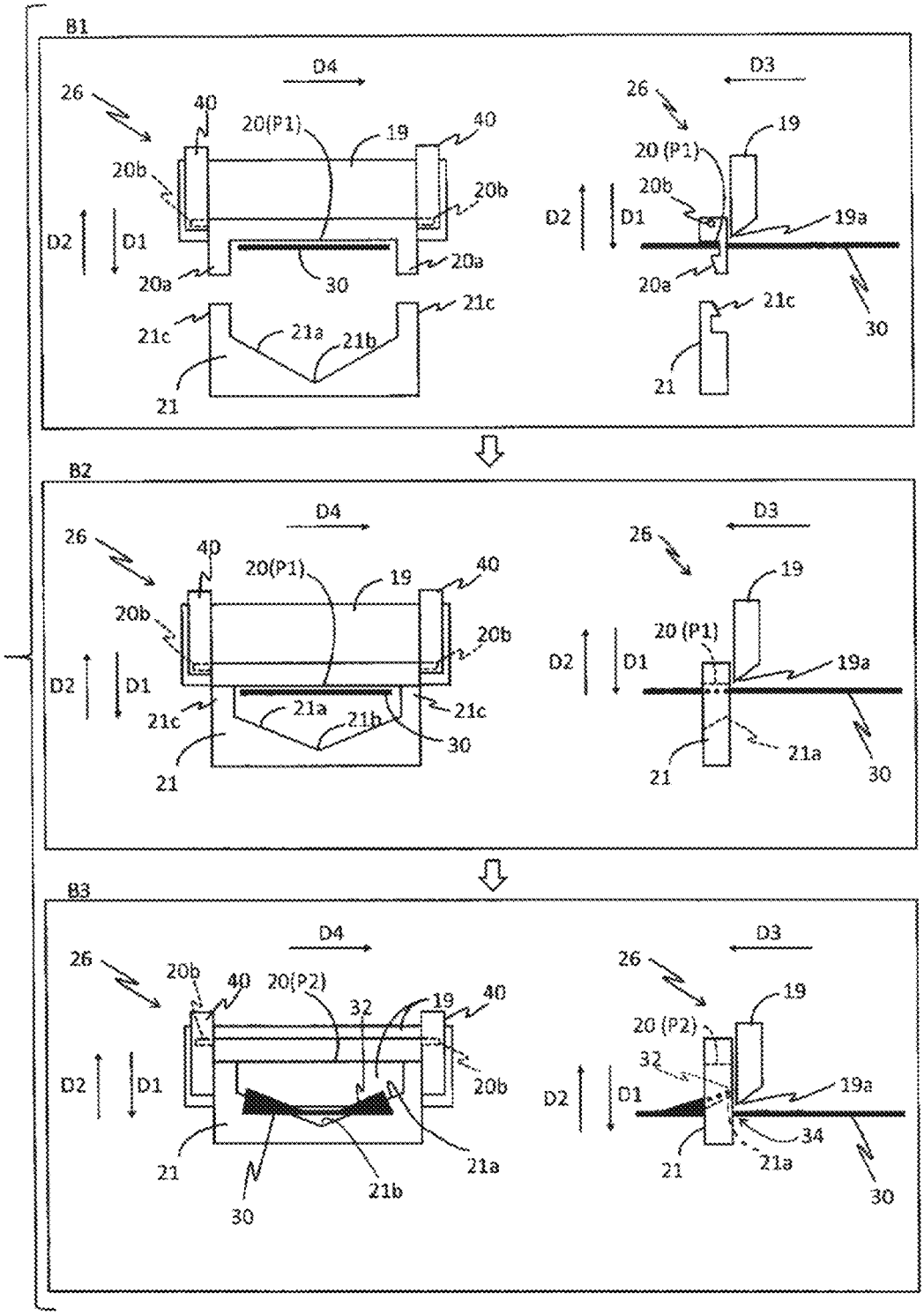
FIG. 7 is a diagram illustrating an operation of the cutter device according to a second example.
Figure 8:
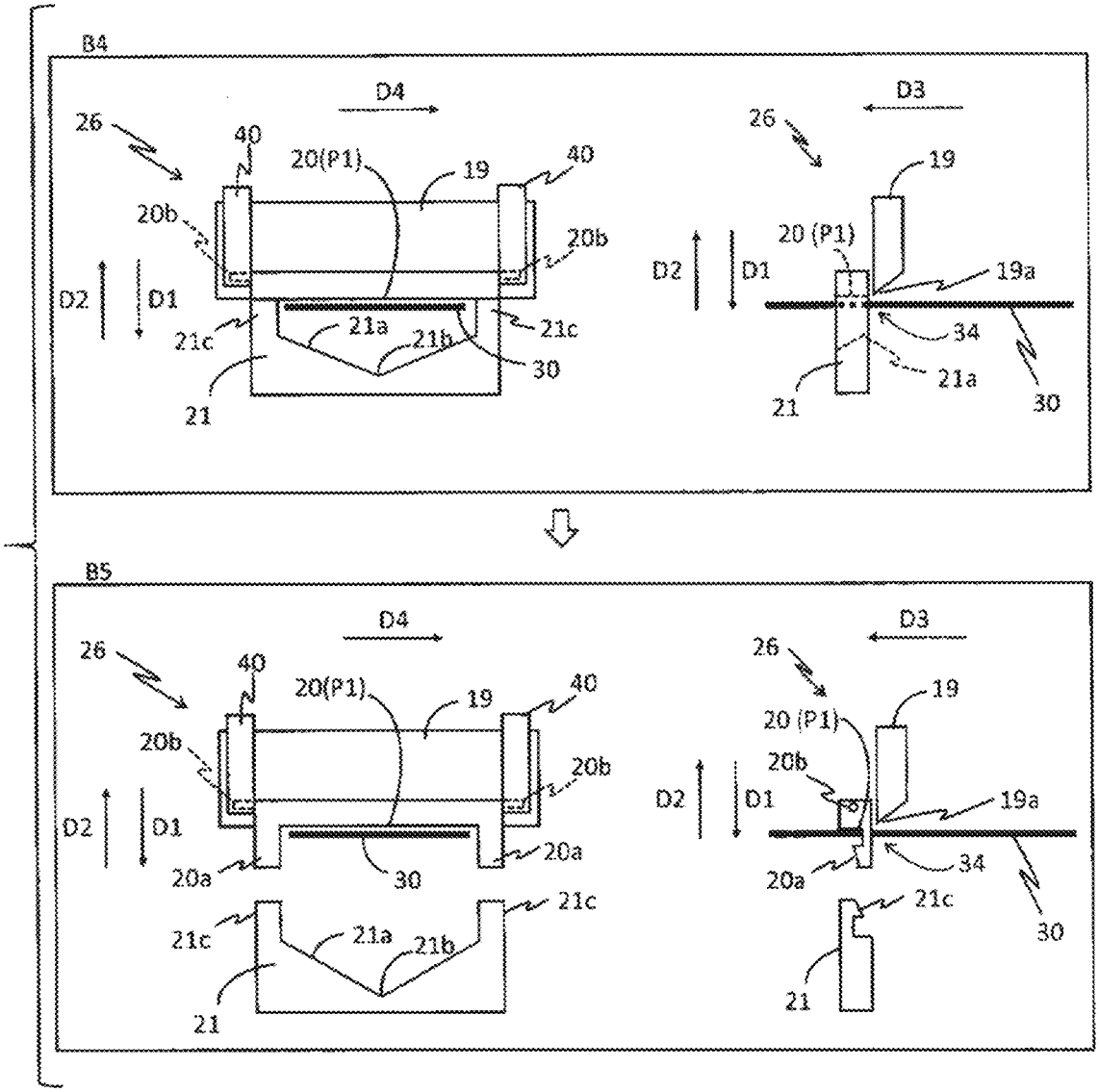
FIG. 8 is a diagram illustrating the operation of the cutter device according to the second example.

FIGS. 7 and 8 illustrate a situation where an operation of the cutter device 26 in a second example transitions to states B1, B2, B3, B4, and B5. Also, in FIGS. 7 and 8, for each of the states B1, B2, B3, B4, and B5, a front view of the cutter device 26 is illustrated on the left, and a side view of the cutter device 26 is illustrated on the right. In the second example and a third example described below, the description of the content common to the first example is omitted as appropriate.

In the second example, the movable blade 21 and the guide portion 20 are separate members. A shape of end portions of the cutting edge 21*a* and the guide portion 20 that face the recording medium 30 by the movable blade 21 and the guide portion 20 coupled to each other may be understood to be substantially the same as a shape of the hole in the movement member 29 in the first example. In the second example, the movable blade 21 is disposed on the lid 12, and the guide portion 20 is disposed on the printer main body 11.

The state B1 indicates a state in which the movable blade 21 and the guide portion 20 are not coupled to each other. The recording medium 30 passes between the movable blade 21 and the guide portion 20. In the state B1, the guide portion 20 is located in the guide position P1. In the second example, the guide portion 20 is held so as not to move in the first direction D1 relative to the guide position P1. The means for holding the guide portion 20 in this manner is particularly no object.

As one example, the guide portion 20 is held by a holding portion 40 disposed outside each of both ends of a width of the guide portion 20. The holding portion 40 is fixed to the printer main body 11. The guide portion 20 includes a protrusion 20*b* that protrudes outward from each of the both ends of the width. The protrusion 20*b* is inserted into a groove formed in the holding portion 40, and thus the guide portion 20 is prohibited from moving below the guide position P1. On the other hand, the groove in the holding portion 40 is formed continuously in the second direction D2. Thus, the guide portion 20 can move above the guide position P1 while being held by the holding portion 40. In FIGS. 7 and 8, the description of the holding portion 40 is omitted in the side view of each of the states.

In the second example, the guide portion 20 and the movable blade 21 include engagement portions for being coupled to each other. The guide portion 20 includes an engagement portion 20*a* extending in the first direction D1 from each position in which the guide portion 20 does not interfere with the recording medium 30 in the vicinity of each of the both ends of the width. On the other hand, the movable blade 21 includes an engagement portion 21*c* extending in the second direction D2 from each position in which the movable blade 21 does not interfere with the recording medium 30 in the vicinity of each of the both ends of the width. The side views of the state B1 and the state B5 illustrate the shape of such engaging portions 20*a* and 21*c*. In the side views of the states B2, B3, and B4, the description of the shape of the engagement portions 20*a* and 21*c* is omitted. Of course, the shape of the engagement portions 20*a* and 21*c* is not limited to that illustrated. The engagement portions 20*a* and 21*c* may be structures that can be coupled to each other with a certain degree of strength such that one is hooked on the other when the movable blade 21 approaches the guide portion 20 and the like.

A state in which the engagement portions 20*a* and 21*c* are engaged with each other by moving the movable blade 21 in the state B1 in the second direction D2, and the movable blade 21 and the guide portion 20 are coupled to each other is the state B2. In the state B2, the guide portion 20 is located in the guide position P1 similarly to the state B1. As described above, a position of the movable blade 21 when the guide portion 20 is located in the guide position P1 is a non-cutting position.

A state in which the movable blade 21 in the state B2 is moved in the second direction D2 is the state B3. In other words, the movable blade 21 coupled to the guide portion 20 located in the guide position P1 moves further in the second direction D2, and thus the movable blade 21 and the guide portion 20 move together while the movable blade 21 pushes the guide portion 20. The movement of the movable blade 21 in the second direction D2 stops at timing earlier than timing at which the deepest portion 21*b* of the cutting edge 21*a* reaches the recording medium 30. In other words, in the process of transitioning from the state B2 to the state B3, the partial cutting of the recording medium 30 is performed. In the state B3 in which the partial cutting is terminated, the guide portion 20 is located in the retracted position P2.

When the movable blade 21 in the state B3 is moved in the first direction D1, the guide portion 20 coupled to the movable blade 21 moves in the first direction D1 together with the movable blade 21. A state in which a position of the guide portion 20 is set to the guide position P1 again by the movement in the first direction D1 in this manner is the state B4. The guide portion 20 pushes the end portion 32 of the recording medium 30 back in the first direction D1 by moving the guide portion 20 in the first direction D1 after the partial cutting. When the guide portion 20 reaches the guide position P1, a partial region of the recording medium 30 including the end portion 32 returns to the original position between the cutting edge 19*a* of the fixed blade 19 and the cutting edge 21*a* of the movable blade 21, and the contact as described above does not occur.

When the movable blade 21 in the state B4 is moved further in the first direction D1, the guide portion 20 is prevented from moving in the first direction D1 relative to the guide position P1, and thus coupling of the movable blade 21 and the guide portion 20 is released. The state in which the coupling to the guide portion 20 is released by the movement of the movable blade 21 in the first direction D1 in this manner is the state B5.

Figure 5:
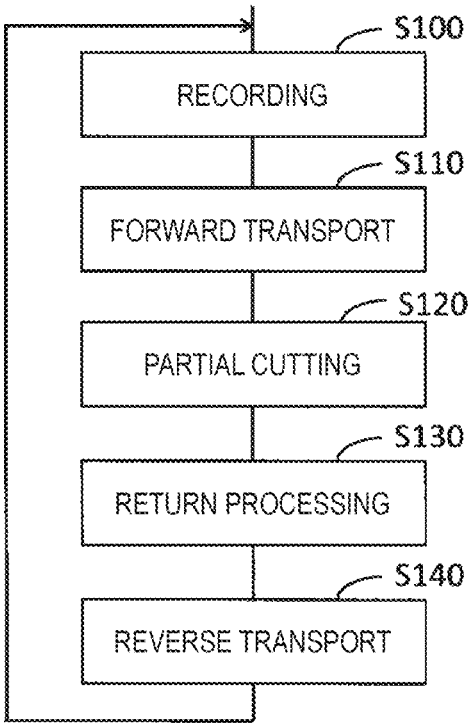
FIG. 5 is a flowchart illustrating recording processing.

The description based on FIGS. 4 and 5 is also applied to the second example. In other words, in step S120, the control unit 13 moves the movable blade 21 by controlling the movable blade drive unit 22, and performs the operation from the state B1 to the state B3 through the state B2 or the operation from the state B2 to the state B3. Further, in step S130, the control unit 13 moves the movable blade 21 by controlling the movable blade drive unit 22, and performs the operation from the state B3 to the state B5 through the state B4 or the operation from the state B3 to the state B4.

2-3. Third Example

Figure 9:
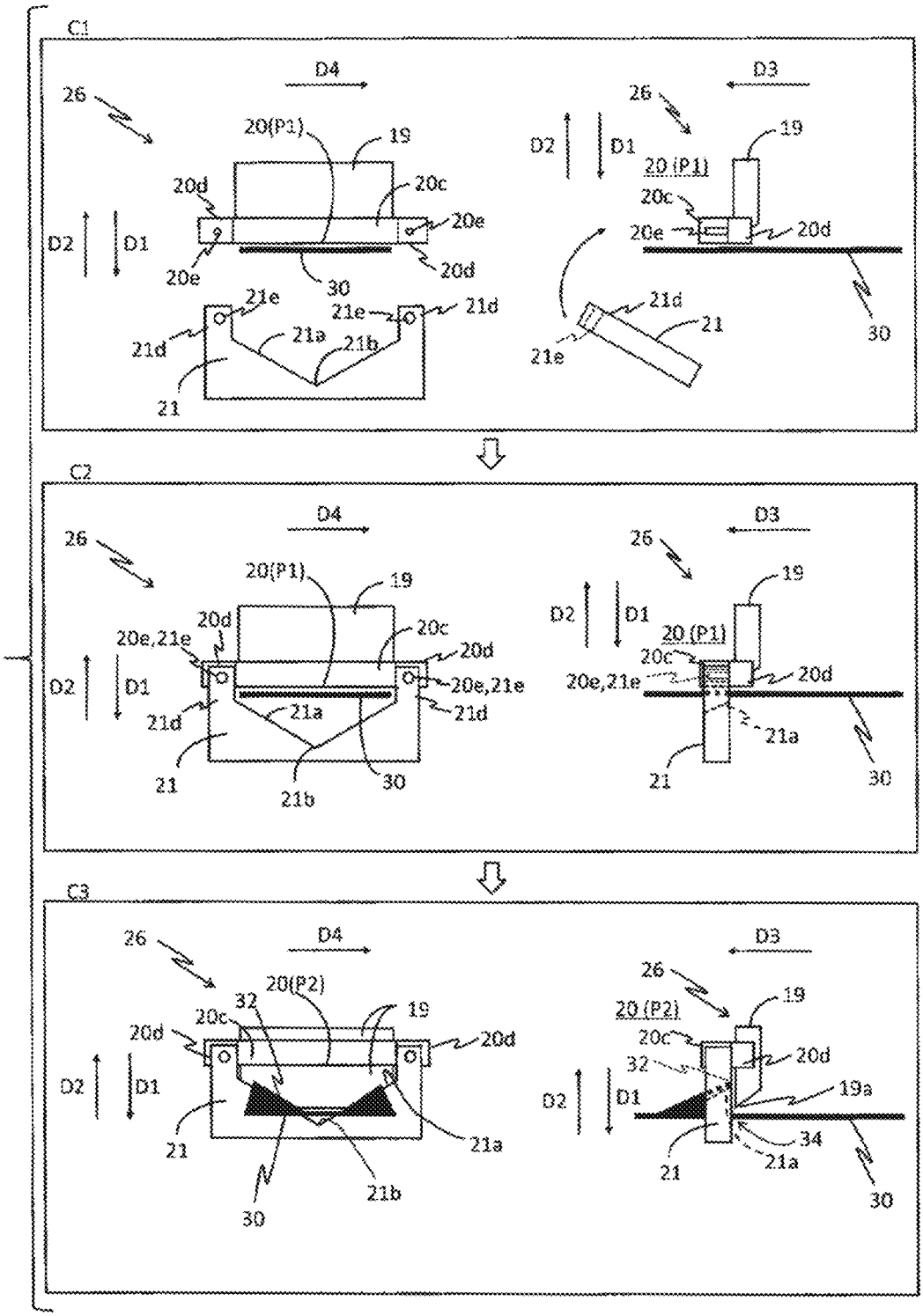
FIG. 9 is a diagram illustrating an operation of the cutter device according to a third example.
Figure 10:
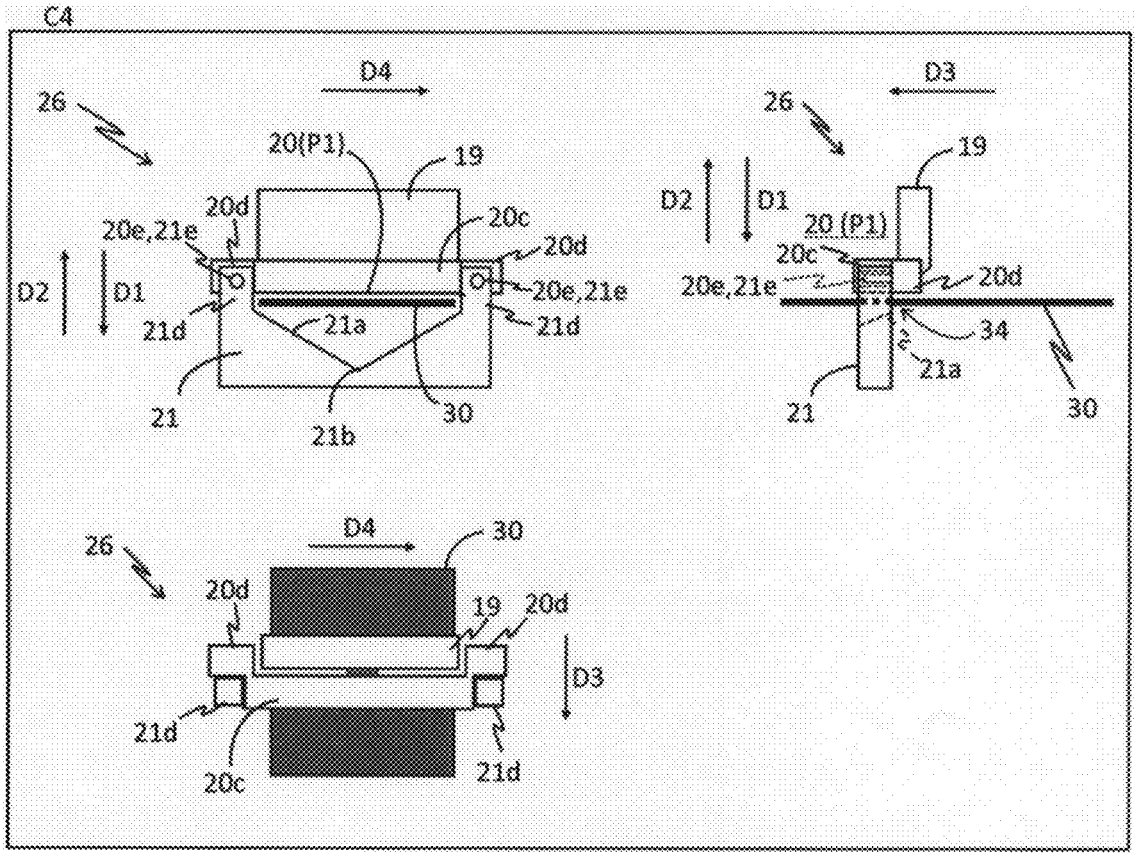
FIG. 10 is a diagram illustrating the operation of the cutter device according to the third example.

FIGS. 9 and 10 illustrate a situation where an operation of the cutter device 26 in the third example transitions to states C1, C2, C3, and C4. Also, in FIGS. 9 and 10, for each of the states C1, C2, C3, and C4, a front view of the cutter device 26 is illustrated on the left, and a side view of the cutter device 26 is illustrated on the right. However, in regard to the state C4, a top view of the cutter device 26 illustrated from a viewpoint from above is also described.

In the third example, the movable blade 21 and the guide portion 20 are separate members similarly to the second example. A shape of the end portions of the cutting edge 21*a* and the guide portion 20 that face the recording medium 30 by the movable blade 21 and the guide portion 20 coupled to each other may be understood to be substantially the same as a shape of the hole in the movement member 29 in the first example. In the third example, the movable blade 21 is disposed on the lid 12, and the guide portion 20 is disposed on the printer main body 11.

The state C1 indicates a state in which the movable blade 21 and the guide portion 20 are not coupled to each other. The recording medium 30 passes between the movable blade 21 and the guide portion 20. In the state C1, the guide portion 20 is located in the guide position P1. In the third example, the guide portion 20 is also held so as not to move in the first direction D1 relative to the guide position P1, similarly to the second example. In FIGS. 9 and 10, description of the means for holding the guide portion 20 so as not to move the guide portion 20 in the first direction D1 relative to the guide position P1 is omitted. The guide portion 20 may be held so as not to be able to move in the first direction D1 relative to the guide position P1 by a stopper (not illustrated) provided on the fixed blade 19, for example.

In the third example, when the lid 12 rotationally moves and is closed with respect to the printer main body 11 as described in FIG. 2, the guide portion 20 and the movable blade 21 are coupled to each other. Both ends of the width of the guide portion 20 extend outward farther than the width of the recording medium 30 and the fixed blade 19, and the guide portion 20 includes, on an extending portion 20*d* extending in this manner, a protrusion 20*e* that protrudes downstream. On the other hand, the movable blade 21 includes an extending portion 21*d* extending in the second direction D2 from each position in which the movable blade 21 does not interfere with the recording medium 30 in the vicinity of each of the both ends of the width. A hole 21*e* is formed in the extending portion 21*d* of the movable blade 21 in an orientation that penetrates a thickness of the movable blade 21. The movable blade 21 disposed on the lid 12 rotationally moves together with the lid 12, and is formed such that the hole 21*e* of the extending portion 21*d* fits to the protrusion 20*e* of the extending portion 20*d* of the guide portion 20 when the lid 12 is closed with respect to the printer main body 11. Such a protrusion 20*e* of the guide portion 20 and a hole 21*e* of the movable blade 21 are a type of engagement portions for coupling the guide portion 20 and the movable blade 21 to each other. Of course, a hole as an engagement portion may be formed in the guide portion 20, and a protrusion as an engagement portion may be formed in the movable blade 21.

A state in which the movable blade 21 illustrated in the side view of the state C1 rotationally moves together with the lid 12, and is coupled to the guide portion 20 is the state C2. In the state C2, the guide portion 20 is located in the guide position P1 similarly to the state C1. As described above, a position of the movable blade 21 when the guide portion 20 is located in the guide position P1 is a non-cutting position.

With reference to the top view illustrated in state C4, a positional relationship between the fixed blade 19, the guide portion 20, and the movable blade 21 can be more understood. The positional relationship between the fixed blade 19, the guide portion 20, and the movable blade 21 illustrated in the top view is also similar in the state C2 and the state C3. The guide portion 20 includes a guide portion main body 20*c* located downstream of the fixed blade 19, and the extending portion 20*d* that extends outward from each of both ends of a width of the guide portion main body 20*c*. The guide portion main body 20*c* is a portion that plays the same role as the guide portion 20 described in the first example and the second example, and can guide the recording medium 30 by the end portion facing the recording medium 30.

The extending portion 20*d* is located upstream of the guide portion main body 20*c* and is coupled to the guide portion main body 20*c*. Then, the protrusion 20*e* protrudes downstream from the surface facing downstream of the extending portion 20*d*. When the extending portion 21*d* of the movable blade 21 abuts such a surface facing downstream of the extending portion 20*d*, the projection 20*e* and the hole 21*e* fit to each other as described above, and the movable blade 21 and the guide portion 20 are coupled to each other. In the state in which the movable blade 21 and the guide portion 20 are coupled to each other, the guide portion main body 20*c* and the movable blade 21 are located in substantially the same position in the transport direction D3.

A state in which the movable blade 21 in the state C2 is moved in the second direction D2 is the state C3. In other words, the movable blade 21 coupled to the guide portion 20 located in the guide position P1 moves further in the second direction D2, and thus the movable blade 21 and the guide portion 20 move together while the movable blade 21 pushes the guide portion 20. The movement of the movable blade 21 in the second direction D2 stops at timing earlier than timing at which the deepest portion 21*b* of the cutting edge 21*a* reaches the recording medium 30. In other words, in the process of transitioning from the state C2 to the state C3, the partial cutting of the recording medium 30 is performed. In the state C3 in which the partial cutting is terminated, the guide portion 20 is in located in the retracted position P2.

When the movable blade 21 in the state C3 is moved in the first direction D1, the guide portion 20 coupled to the movable blade 21 moves in the first direction D1 together with the movable blade 21. A state in which a position of the guide portion 20 is set to the guide position P1 again by the movement in the first direction D1 in this manner is the state C4. The guide portion main body 20*c* of the guide portion 20 pushes the end portion 32 of the recording medium 30 back in the first direction D1 by moving the guide portion 20 in the first direction D1 after the partial cutting. When the guide portion 20 reaches the guide position P1, a partial region of the recording medium 30 including the end portion 32 returns to the original position between the cutting edge 19*a* of the fixed blade 19 and the cutting edge 21*a* of the movable blade 21, and the contact as described above does not occur. When the user opens the lid 12, the movable blade 21 is separated from the guide portion 20, and the coupling of the movable blade 21 and the guide portion 20 is released.

The description based on FIGS. 4 and 5 is also applied to the third example. In other words, in step S120, the control unit 13 moves the movable blade 21 by controlling the movable blade drive unit 22, and performs the operation from the state C2 to the state C3. Further, in step S130, the control unit 13 moves the movable blade 21 by controlling the movable blade drive unit 22, and performs the operation from the state C3 to the state C4.

3. SUMMARY

According to the present exemplary embodiment, the cutter device 26 includes the fixed blade 19 including the first cutting edge (cutting edge 19*a*) facing in the first direction D1 that intersects the transport direction D3 of the recording medium 30, and the movable blade 21 that includes the second cutting edge (cutting edge 21*a*) facing in the second direction D2 being a reverse direction to the first direction D1, can move in the first direction D1 and the second direction D2, to cut the recording medium 30 located between the cutting edge 19*a* and the cutting edge 21*a* while leaving a part uncut by moving in the second direction D2. Furthermore, the cutter device 26 includes the guide portion 20 that is located forward of the movable blade 21 in the second direction D2, moves together with the movable blade 21, and is located in the guide position P1 that is a position in which at least a part thereof protrudes farther than the cutting edge 19*a* in the first direction D1 or that is the same position as the cutting edge 19*a* when the movable blade 21 is located in the rear in the second direction D2 relative to a position in which the movable blade 21 cuts the recording medium 30.

According to the configuration described above, the movable blade 21 and the guide portion 20 move together. Then, when the movable blade 21 is located in the non-cutting position, the guide portion 20 is located in the guide position P1. Therefore, by moving the movable blade 21 to the non-cutting position, the guide portion 20 can act on the end portion 32 of the recording medium 30 generated by the partial cutting, and move the end portion 32 back to a position that is not in contact with the fixed blade 19. In this way, when the recording medium 30 is back-fed after the partial cutting, contact between the recording medium 30 and the fixed blade 19 does not occur, and the back-feeding can be performed smoothly.

Further, according to the first example, the movable blade 21 and the guide portion 20 are formed by an integral member.

According to the configuration described above, the movable blade 21 and the guide portion 20 can also be reliably moved together in addition to reducing the number of parts.

Further, the movable blade 21 and the guide portion 20 may form a hole that is a hole through which the recording medium 30 passes and that has the entire circumference closed.

According to the configuration described above, the movable blade 21 and the guide portion 20 can be easily formed from one member.

Further, according to the second example and the third example, the movable blade 21 and the guide portion 20 are separate members. Then, the guide portion 20 is coupled to the movable blade 21 and moves together with the movable blade 21 in a period of movement in the second direction D2 with the guide position P1 as a start position of the movement and a period of movement in the first direction D1 with the guide position P1 as a termination position of the movement.

According to the configuration described above, the movable blade 21 and the guide portion 20 can be moved together in a period of the partial cutting from a state in which the guide portion 20 is located in the guide position P1 and a period in which the guide portion 20 returns to the guide position P1 after the partial cutting.

Further, when the movable blade 21 and the guide portion 20 are separate members, the fixed blade 19 and the guide portion 20 may be disposed on the first structure, the movable blade 21 may be disposed on the second structure different from the first structure, and a posture of the second structure may be changed with respect to the first structure.

According to the configuration described above, the recording medium 30 can be set between the fixed blade 19 and the guide portion 20, and the movable blade 21 by passing the recording medium 30 between the first structure and the second structure.

Note that the exemplary embodiments described above merely represent one aspect of the present disclosure and any variation and application may be possible within the scope of the present disclosure.

In addition to the cutter device 26, the printer 10 including the cutter device 26 can also be considered as the disclosure. Further, the operation of the cutter device 26 and the operation of the printer 10 including the cutter device 26 can also be considered as the method.

The printer 10 may be a device that performs recording by a method that is not an inkjet method. For example, instead of the recording head 15, the printer 10 may include a printer engine that attaches the toner to the recording medium 30 by an electrophotographic method and performs recording. Further, the printer 10 may be a thermal printer.

The platen 18 may be a platen roller having a function of a transport roller. In this case, the transport motor 27 drives the platen roller, and transports the recording medium 30 by the platen roller. Therefore, the transport unit may be configured to include only the platen roller and the transport motor 27.

What is claimed is:

1. A cutter device, comprising:

a first blade including a first cutting edge extending in a first direction;

a second blade including a second cutting edge extending in a second direction; and a guide portion provided at a position anterior to the second blade in the second direction, wherein the second blade moves in the second direction to cut a recording medium while leaving a part thereof uncut, when the second blade is located posterior, in the second direction, to a position where the second blade cuts the recording medium, at least a part of the guide portion is located to protrude farther in the first direction than the first cutting edge, or located at a same position as the first cutting edge, and the first blade is provided in a first structure, the second blade is provided in a second structure that is different from the first structure, and a posture of the second structure is changeable with respect to the first structure.

2. The cutter device according to claim 1, wherein the second blade and the guide portion are formed as an integral member.

3. The cutter device according to claim 2, wherein the second blade and the guide portion form a hole through which the recording medium passes.

4. The cutter device according to claim 1, wherein the second blade and the guide portion are members separate from each other, and during movement of the second blade in the second direction and during movement of the second blade in the first direction, the guide portion is coupled to the second blade and moves together with the second blade.

5. The cutter device according to claim 1, wherein the first blade and the guide portion are provided in the first structure.

6. A printer, comprising:

a printing head configured to perform printing on the recording medium; and the cutter device according to claim 1.

7. The cutter device according to claim 1, wherein the second blade and the guide portion are provided in the second structure.

* * * * *